US011542586B2

(12) United States Patent
Bechelany et al.

(10) Patent No.: US 11,542,586 B2
(45) Date of Patent: Jan. 3, 2023

(54) COATING FOR REFRACTORY ALLOY PART

(71) Applicants: COMMISSARIAT A L'ENERGIE ATOMIQUE ET AUX ENERGIES ALTERNATIVES, Paris (FR); SAFRAN, Paris (FR)

(72) Inventors: Mirna Bechelany, Moissy Cramayel (FR); Virginie Jaquet, Moissy Cramayel (FR); Amar Saboundji, Moissy Cramayel (FR); Mathieu Soulier, Saint Jean de Moirans (FR); Mathieu Boidot, Gieres (FR); Richard Laucournet, La Buisse (FR)

(73) Assignees: COMMISSARIAT A L'ENERGIE ATOMIQUE ET AUX ENERGIES ALTERNATIVES, Paris (FR); SAFRAN, Paris (FR)

( * ) Notice: Subject to any disclaimer, the term of this patent is extended or adjusted under 35 U.S.C. 154(b) by 0 days.

(21) Appl. No.: 17/265,835

(22) PCT Filed: Aug. 7, 2019

(86) PCT No.: PCT/FR2019/051916
§ 371 (c)(1),
(2) Date: Feb. 4, 2021

(87) PCT Pub. No.: WO2020/030880
PCT Pub. Date: Feb. 13, 2020

(65) Prior Publication Data

US 2021/0292882 A1 Sep. 23, 2021

(30) Foreign Application Priority Data

Aug. 7, 2018 (FR) ..... 18/00849

(51) Int. Cl.
*C23C 10/52* (2006.01)
*C23C 10/58* (2006.01)
(Continued)

(52) U.S. Cl.
CPC ..... *C23C 10/52* (2013.01); *C23C 10/58* (2013.01); *C23C 28/021* (2013.01);
(Continued)

(58) Field of Classification Search
CPC ..... C23C 10/28; C23C 10/34; C23C 10/42; C23C 10/44; C23C 10/48; C23C 10/52;
(Continued)

(56) References Cited

U.S. PATENT DOCUMENTS 3,061,463 A 10/1962 Samuel
3,690,934 A * 9/1972 Galmiche ..... C23C 10/58 416/241 R
(Continued)

FOREIGN PATENT DOCUMENTS

EP 0846929 A2 * 10/1998
FR 2030314 A1 11/1970
(Continued)

OTHER PUBLICATIONS

International Search Report DATED Sep. 19, 2019 in International Application No. PCT/FR2019/051916.
(Continued)

*Primary Examiner* — Brian K Talbot
(74) *Attorney, Agent, or Firm* — Sughrue Mion, PLLC

(57) ABSTRACT

A process for coating a part by chemical vapor diffusion is provided and includes placing a powder mixture in a chamber, immersing the part partially in the powder mixture, and applying a heat treatment to the part. The powder mixture includes a first component and a second component forming a gaseous compound during the heat treatment so as to allow
(Continued)

deposition of the second component on the part. The part includes a metal refractory allow and the second component forms a solid diffusion alloy by solid diffusion with a metal species of the refractory metal alloy to generate a coating. The solid diffusion allow generates a passivating oxide layer when subjected to oxidizing conditions.

7 Claims, 1 Drawing Sheet

(51) Int. Cl.

| | |
|---|---|
| ***C23C 28/02*** | (2006.01) |
| *C23C 10/34* | (2006.01) |
| *C23C 10/42* | (2006.01) |
| *C23C 10/44* | (2006.01) |
| *C23C 10/28* | (2006.01) |
| *C23C 10/48* | (2006.01) |

(52) U.S. Cl.
CPC ..... *C23C 28/023* (2013.01); *C23C 10/28* (2013.01); *C23C 10/34* (2013.01); *C23C 10/42* (2013.01); *C23C 10/44* (2013.01); *C23C 10/48* (2013.01); *C23C 28/02* (2013.01)

(58) Field of Classification Search
CPC ..... C23C 10/20; C23C 28/02; C23C 28/21; C23C 28/23
USPC ..... 427/255.12, 255.15, 255.18, 252
See application file for complete search history.

(56) References Cited

U.S. PATENT DOCUMENTS 3,873,347 A * 3/1975 Walker ..... C23C 14/16 427/250
4,055,706 A * 10/1977 Galmiche ..... C22C 47/00 427/377
5,141,776 A * 8/1992 Merzhanov ..... C23C 12/02 427/255.393
5,161,898 A * 11/1992 Drake ..... F16C 33/12 384/95
5,194,219 A * 3/1993 Baldi ..... C23C 10/48 149/6
6,887,519 B1 * 5/2005 Pillhoffer ..... C23C 24/08 427/253
7,390,534 B2 * 6/2008 Park ..... C23C 10/30 427/376.6
2004/0219295 A1 * 11/2004 Perepezko ..... C23C 10/60 427/255.27
2006/0003567 A1 * 1/2006 Yoon ..... C23C 16/30 438/604
2007/0009660 A1 * 1/2007 Sasaki ..... F01D 5/005 427/140
2007/0272331 A1 * 11/2007 Strasser ..... C23C 10/04 148/279
2016/0376693 A1 * 12/2016 Wang ..... C09D 5/10 106/287.18
2020/0080184 A1 * 3/2020 Walter ..... C23C 10/60

FOREIGN PATENT DOCUMENTS

FR 2320362 A2 3/1977
FR 2769852 A1 4/1999

OTHER PUBLICATIONS

Search Report dated May 23, 2019 in French Application No. 1800849.

* cited by examiner

FIG. 1
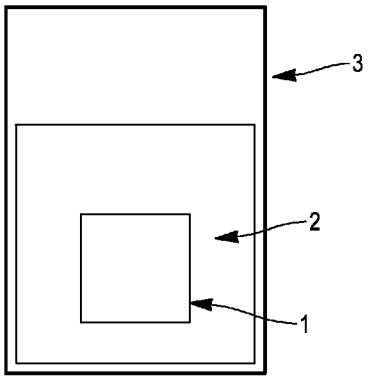
FIG. 2
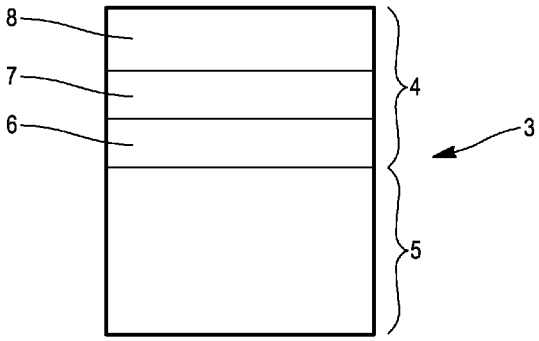
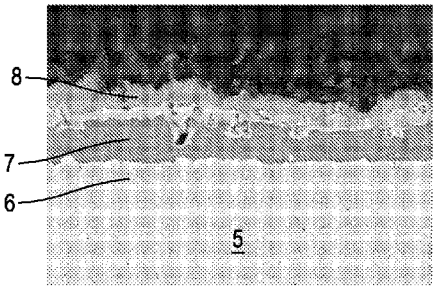
FIG. 3a
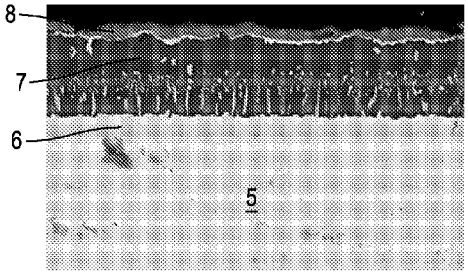
FIG. 3b

COATING FOR REFRACTORY ALLOY PART

CROSS-REFERENCE TO RELATED APPLICATIONS

This application is a National Stage of International Application No. PCT/FR2019/051916 filed Aug. 7, 2019, which claims priority under U.S.C. § 119(a) to French Patent Application No. 1800849 filed on Aug. 7, 2018, the entire contents of each of which are herein incorporated by reference in their entireties.

GENERAL TECHNICAL FIELD AND PRIOR ART

The invention relates to the field of protective coatings for mechanical parts, more precisely coatings for refractory alloy parts.

During a foundry manufacturing process, cores are conventionally placed in foundry molds, prior to the injection of the liquid metal, so as to create one or more cavities or recesses in the parts that will be made during the manufacturing process.

These cores are conventionally made of refractory ceramics (silica, alumina, zirconia, etc.).

Alternatively, it is known to use foundry cores made of refractory alloys to replace or complement the ceramic cores conventionally used.

These refractory alloy materials, typically molybdenum alloys, must be coated with a protective layer to preserve their mechanical characteristics, in particular in the presence of very high temperatures encountered for example during the manufacturing process of superalloy blades for gas turbines.

In the case of investment casting processes, shells made of refractory material are made around a wax model of the part to be made, so as to form a mold of the model of the part. The shell is then heated to be consolidated, the wax being evacuated beforehand in an autoclave under steam to produce an impression of the external shape of the part to be made.

A core can be initially placed in the wax model and present before the casting of the material constituting the part to be made, the core defining the internal shape of the part.

In the case of the production of gas turbine blades, typically superalloy turbine blades in investment casting, the consolidation of the blade shell is carried out under air at a temperature greater than 1000° C. Significant oxidation phenomena may be encountered, particularly of the refractory metal that constitutes part of the core or the complete core.

Indeed, molybdenum for example, which can be used as an insert in a ceramic core or can constitute the entire core, reacts, with oxygen from 400° C. to form molybdenum dioxide ($MoO_2$) up to 650° C. and then molybdenum trioxide above 650° C., molybdenum trioxide being highly volatile. The oxidation rate of molybdenum follows in a known manner a linear increase between 400 and 650° C. and an exponential increase beyond that up to 1700° C.

Alternatively, it is known to use a molybdenum-based alloy containing zirconium and titanium (TZM alloy), which is more easily machinable and has a higher mechanical strength than molybdenum at room temperature. TZM is known to oxidize from 540° C. and oxidation becomes exponential from 790° C. with rapid volatilization of the TZM substrate (in the field of surface coatings, the substrate is the material composing the part to be coated).

This very significant oxidation of molybdenum or TZM parts leads to a significant loss of mass and a rapid degradation of mechanical properties.

After air consolidation of the shell, the superalloy is melted and vacuum cast into the shell, thus coming into contact with the refractory alloy.

The casting step, carried out under vacuum at a temperature greater than 1500° C., leads in particular to phenomena of diffusion of superalloy elements into the refractory alloy of the core.

An interdiffusion of the refractory alloy elements from the core to the superalloy can lead to a modification of the composition of the cast alloy and therefore of the mechanical properties of the superalloy, and lead to a degradation of the performance of the part obtained.

It is known to produce a coating of silicon-molybdenum alloy $MoSi_2$ known for its ability to protect molybdenum and molybdenum alloys against high-temperature oxidation, the coating being produced by a chemical vapor diffusion process, also called active carburization.

Such a process is carried out by causing a surface diffusion of one or more chemical elements with one of the species contained in a part 1.

The chemical elements diffusing in the part 1 are here called doping components and come from so-called precursor components in solid form.

Such a process has the advantage of being easy to implement, inexpensive and allows objects of complex shape to be coated because the deposition method is non-directional, in the sense that the doping component is not sprayed by a directional jet onto the part 1.

In the case of a refractory alloy Part 1, for example molybdenum or a molybdenum/titanium/zirconium (TZM) alloy, the doping component will react by diffusion with the molybdenum in the part 1 and form an alloy.

To carry out a diffusion of a doping component onto parts, the solid precursors used are contained in a mixture of so-called carburizing powders 2, including in particular a powder of the doping component to be diffused.

The powder mixture 2 must also comprise an activator component and an inert component.

The activator component is conventionally a halide configured to form a gaseous metal chloride with the doping component(s) during the heat treatment, chloride which reduces on the surface of the part 1 to deposit the metal element of the chloride.

The inert component is configured to increase the volume of powder and thus immerse the part 1 to be coated and control the temperature rise in the chamber 3 and thus control the characteristics of the coating obtained.

In the case of a part 1 made of molybdenum or an alloy containing chiefly molybdenum, the powder mixture 2 comprises a powder of the doping component M, an activating halide powder $NH_4Cl$ and an alumina powder as inert material.

The powder mixture is introduced into a chamber 3 or crucible, then the part 1 to be coated is at least partially immersed in the powder mixture 2 before sealing the chamber 3.

A heat treatment is then carried out, during which the chamber 3 is heated, thus heating the powder mixture 2.

The activator component decomposes to form gaseous hydrogen chloride (HCl), which reacts with the doping component powders to form a so-called doping chloride M-$Cl_X$, M being the doping component), which is also gaseous.

The doping chloride M-$Cl_X$ is reduced on the surface of the part 1 in the presence of hydrogen $H_2$, in particular produced by the decomposition of hydrogen chloride, to deposit the doping component on the surface of the part 1.

At high temperature (between 850° C. and 1300° C.), solid diffusion of the surface-deposited doping component into the alloy of the part 1 to be coated forms a surface alloy of the part 1.

For example, a silicon-molybdenum alloy $Mo_aSi_b$ coating on a molybdenum alloy part 1 is obtained by active carburization of a doping component comprising silicon, whose reaction with the activator component comprising hydrogen chloride HCl leads to the formation of silicon tetrachloride.

The silicon tetrachloride thus formed is then reduced to silicon on the surface of the molybdenum alloy part 1 in the presence of dihydrogen. The silicon layer then reacts by solid diffusion with the molybdenum to form a silicon-molybdenum alloy. The coating consisting of the alloy $MoSi_2$ thus forms a passivating oxide layer $SiO_2$ which protects the part 1 from oxidation. In the case of cores for high-pressure turbine blades, this silica layer is not recommended because it is reactive with certain elements of the nickel-based superalloy (for example aluminum, hafnium, titanium, etc.) and the coated refractory metal core can then react with the superalloy.

It is also known to add to the powder mixture 2 a third alloying component (i.e., capable of forming a compound with the first two), in order to form a so-called ternary coating of composition $Mo_aX_bY_c$.

It is for example described in the literature to add aluminum powder to the powder mixture 2 in addition to silicon.

Aluminum is an alloying element of molybdenum silicide and will form a coating consisting of a molybdenum-silicon-aluminum $Mo_a$—$Si_b$—$Al_c$ ternary alloy.

During the heat treatment, gaseous silicon chloride $SiCl_4$ and gaseous aluminum chloride $AlCl_3$ are formed and reduced on the molybdenum alloy part 1. Solid-state diffusion at high temperature (between 850° C. and 1300° C.) subsequently forms a molybdenum-silicon-aluminum Mo—Si—Al ternary alloy on the surface of the part 1.

The addition of aluminum makes it possible for example to form coatings of composition $Mo(Si,Al)_2$ on parts comprising molybdenum or a molybdenum alloy. This layer has a good resistance to oxidation by forming a passivating alumina layer at temperature in an oxidizing atmosphere. In the case where the coating is applied to a turbine blade refractory core, a $Mo(Si,Al)_2$ coating is more suitable than the $MoSi_2$ coating because the alumina layer formed in the first case is an effective barrier to the reactivity of the refractory core with the superalloy, which is not the case with silica.

Aluminum in the coating also increases the ductility of the layer and thus has better mechanical properties.

However, these solutions have limits in terms of corrosion resistance during cycling due to the progressive cracking of $MoSi_2$ or $Mo(Si,Al)_2$ coatings; under oxidizing conditions, these coatings undergo compositional transformations due to the loss of silicon and/or aluminum by forming passivating silica and/or alumina layers. These differential diffusions of the Si and/or Al elements on the surface of the coating in relation to the molybdenum of the coating lead to the diffusion of gaps causing increasing cracking in the coating (Kirkendall effect). These cracks reduce the oxidation resistance over time of the part 1.

GENERAL PRESENTATION OF THE INVENTION

One aim of the invention is to limit oxidation and interdiffusion phenomena during the heat treatment of blade shells and the casting of superalloys in the presence of refractory alloys.

Another aim of the invention is to allow the use of molybdenum or TZM at temperature and under air for all types of applications.

Another aim of the invention is to propose a solution that adapts to any type of geometry.

Another aim of the invention is to propose an easily achievable solution, with the aim of limiting costs and maximizing production volumes.

To this end, the invention provides a process for coating a metal alloy part by chemical vapor diffusion, the alloy being a refractory alloy, the process comprising the following steps:

- place a powder mixture in a chamber,
- immerse the part at least partially in the powder mixture and
- apply a heat treatment to the part,
  - wherein the powder mixture comprises at least a first component and at least a second component, the first component and the second component forming a gaseous compound during the heat treatment step so as to allow deposition of the second component on the part, the second component being intended to form an alloy by solid diffusion with at least one metal species of the refractory alloy so as to generate a coating, the process being characterized in that the alloy formed by solid diffusion generates a passivating oxide layer when subjected to oxidizing conditions, and wherein the refractory alloy comprises molybdenum, and wherein:
    - the first component comprises at least one halide species selected from the following components: $NH_4Cl$, $NH_4F$, $AlCl_3$, $CrCl_2$;
    - the second component comprising at least one species selected from silicon, aluminum, iron, copper, cobalt, nickel, lanthanum, germanium, zirconium, chromium, titanium, hafnium, rhenium and a mixture thereof,
  - and wherein the powder mixture (2) includes a mass proportion comprised between 8 and 12% of the second component and between 6 and 8% of the first component.

The invention is advantageously complemented by the following features, taken individually or in any one of their technically possible combinations:

- the powder mixture includes a mass proportion comprised between 1 and 20% of the second component, a mass proportion comprised between 1 and 10% of the first component based on the total mass of the powder mixture,
- the second component is a mixture of a silicon powder and an aluminum powder, the first component is ammonium chloride,
- the powder mixture also includes a mass proportion comprised between 70 and 95% of an inert component,
- the powder mixture includes between 82 and 84% by mass of inert component,
- the inert component is an alumina powder.

Another object of the invention is a refractory metal alloy part comprising a coating at least partially covering a substrate, characterized in that the coating is obtainable by means of a process which is the object of the invention.

The invention is advantageously complemented by the following features, taken individually or in any one of their technically possible combinations:

the part comprises molybdenum, and is at least partially covered by a coating, the coating comprising a plurality of superimposed layers, of which at least:

a first layer comprising a solid solution of aluminum and silicon in molybdenum denoted Mo (Si,Al), has a thickness comprised between 1 μm and 10 μm, and has an aluminum molar fraction comprised between 0.1% and 35% and a silicon molar fraction comprised between 0.1% and 25%, a second layer comprising a mass proportion greater than 75% of an aluminum molybdenum alloy $Al_8Mo_3$ and having a thickness comprised between 1 and 20 μm, and a third layer having a thickness comprised between 1 μm and 15 μm and comprising an aluminum-silicon-molybdenum alloy $Mo(Si,Al)_2$, the third layer having a combined atomic fraction of silicon and aluminum comprised between 65% and 68% and configured to generate a passivating oxide layer when exposed to oxidizing conditions;

the part comprises molybdenum, said part being at least partially covered by a coating comprising a plurality of superimposed layers, of which at least:

a first layer (6) comprising a solid solution of aluminum and silicon in molybdenum denoted Mo (Si,Al), has a thickness comprised between 0.1 μm and 1 μm, and has an aluminum molar fraction comprised between 0.1% and 35% and a silicon molar fraction comprised between 0.1% and 25%, a second layer (7) comprising a mass proportion greater than 75% of an aluminum molybdenum alloy $Al_8Mo_3$ and having a thickness comprised between 1 and 30 μm, a third layer (8) having a thickness comprised between 1 μm and 25 μm and comprises an aluminum-silicon-molybdenum alloy $Mo(Si,Al)_2$, the third layer having a combined atomic fraction of silicon and aluminum comprised between 65% and 68% and configured to generate a passive oxide layer when exposed to oxidizing conditions.

PRESENTATION OF THE FIGURES

Other features and advantages of the invention will further emerge from the following description, which is purely illustrative and non-limiting, and should be read in conjunction with the appended figures wherein:

FIG. 1 is a schematic representation of a device for implementing a coating process according to the invention;

FIG. 2 is a schematic representation of the structure of a coating according to the invention;

FIG. 3*a* and FIG. 3*b* are electron microscope section views representing the coating having first, second and third layers; more precisely, FIG. 3*a* and FIG. 3*b* represent cases where the layer comprises molybdenum-aluminum-silicon alloy inclusions.

DESCRIPTION OF ONE OR MORE METHODS OF IMPLEMENTATION AND EMBODIMENTS

Process:

The invention relates to a process for coating a refractory alloy part 1 by chemical vapor diffusion, wherein the part 1 is at least partially immersed in a chamber 3 comprising a mixture of carburizing powders 2 before preforming a heat treatment, the powder mixture comprising at least one activator and at least one doping component, the activator being configured to form a gaseous compound with the doping component during the heat treatment so as to promote deposition of the doping component on the part 1, the doping component being configured to form an alloy by solid diffusion with a species of the refractory alloy so as to generate a coating 4 on the surface of the part 1.

The alloy formed by the doping component and the part 1 is configured to generate a passivating oxide layer when said alloy is subjected to oxidizing conditions.

The powder mixture 2 may comprise a doping component, preferentially in the form of a divided solid (powder), the component being configured to form by solid diffusion an alloy with the refractory alloy support (which is most commonly molybdenum or a molybdenum alloy) to generate the coating 4.

The coating 4 thus formed on the refractory alloy substrate 5 of the part 1 must form a protective layer under oxidizing conditions by generating a passivating oxide layer.

The doping component may comprise:

a silicon powder,
an aluminum powder,
an iron powder,
a copper powder,
a cobalt powder,
a nickel powder,
a lanthanum powder,
a germanium powder,
a zirconium powder,
a chromium powder,
a titanium powder,
a hafnium powder,
a rhenium powder.

Advantageously, the doping component may comprise a powder comprising at least one metal salt.

Advantageously, the powder mixture 2 comprises one or more halide-type activator components, and optionally an inert filler to limit the speed of temperature variation during the heat treatment.

The activator component(s) may comprise one compound or a combination of compounds among the following compounds: $NH_4Cl$, $NH_4F$, $AlCl_3$, $CrCl_2$.

The inert filler is configured to remain in solid form during the heat treatment and not form an alloy with the part 1 nor other species present in the powder mixture or formed during the heat treatment.

It thus increases the volume of the powder mixture 2 so as to immerse the part to be coated 1, but also increases the energy to be supplied to the chamber 3 to increase its temperature, without increasing the mass of reagents, thus controlling the temperature in the chamber 3 and thus the thickness of the coating 4 formed.

The inert filler may optionally comprise alumina $Al_2O_3$ or magnesium oxide MgO powder, silicates, silica, zirconia, cerium oxide, cristobalite, calcium carbonate.

The heat treatment is then performed so as to form an alloy coating 4 on the surface of the refractory alloy substrate 5.

The alloy comprises one or more molybdenum alloys of form $Mo_aX_b$ and/or one or more solid solutions (i.e., molybdenum dissolved in a species X or a species X dissolved in molybdenum). The composition of the alloy coating 4 between X and Mo are the thermodynamically stable compounds defined in the phase diagrams corresponding to the binary alloy Mo—X and to the relative content of Mo and X in the coating.

At least one of the compounds capable of forming the passivating layer in an oxidizing environment must be in the form of a continuous layer, i.e., a layer extending over the entire surface of the part 1 in contact with the oxidizing environment.

An area not covered with a passivating layer would cause the degradation of the part 1 at this location, degradation which can then spread to the entire part 1 whose oxidation is not passivating and therefore uninterrupted.

The obtaining of a continuous layer is conditioned by the formation of sufficient volatile metal chloride during heat treatment to deposit sufficient metal species on the surface. The obtaining of a continuous layer also suggests that the level of stress in this layer is lower than the stress at rupture which, when exceeded, would cause cracking. The level of stress is a function of the thickness of the coating (chosen <100 μm by adapting the content of doping component, the quantity of activator, the temperature and the time of the heat treatment), the difference in the coefficient of expansion between the coating and the support (chosen lower than $6.10^{-6}$ $K^{-1}$).

For example, the silicon in the powder mixture 2 leads to the formation of a molybdenum-silicon alloy phase of form $Mo_aSi_b$. The $MoSi_2$ phase forms a passivating silica layer, under oxidizing conditions.

In another example, the aluminum in the powder mixture 2 leads to the formation of a molybdenum-aluminum alloy phase of form $Mo_aAl_b$, which will form a passivating alumina layer, under oxidizing conditions.

In another example, the nickel in the powder mixture 2 leads to the formation of a molybdenum-nickel alloy phase of form $Mo_aNi_b$, which will form a passivating nickel oxide layer, under oxidizing conditions.

In another example, the chromium in the powder mixture 2 leads to the formation of a molybdenum-chromium alloy phase of form $Mo_aCr_b$, which will form a passivating chrome (III) oxide layer, under oxidizing conditions.

Optionally, the powder mixture 2 may comprise several doping components.

These metal elements added to the powder mixture 2 can be combined to form an alloy coating, for example ternary of form $Mo_aX_bY_c$, or in another example quaternary of form $Mo_aX_bY_cZ_d$.

The doping component is configured to generate a volatile chloride which is then reduced on the surface of the part 1 and deposits the metal element of the chloride.

The doping component can also be configured so that it generates a passivating oxide layer under oxidizing conditions.

Optionally, the process comprises a step of oxidation of the part 1, during which the part 1 and the coating 4 are heated in the presence of air at a temperature of 1150° C., so as to generate a passivating oxide layer on the surface of the coating 4.

Advantageously, to limit the reactivity of the part 1 during superalloy casting, the doping component comprises one of the components, or a combination of components, among aluminum, titanium, chromium, zirconium, hafnium whose respective oxides ($Al_2O_3$, $TiO_2$, $Cr_2O_3$, $ZrO_2$, $HfO_2$) are oxides with high chemical stability in contact with the molten superalloys.

In this way, the passivating oxide layer formed during the oxidation step is inert in contact with a liquid superalloy at 1550° C. under vacuum, for example during foundry molding of a superalloy gas turbine blade. Inert is understood to mean that the passivating oxide layer prevents the diffusion of species between the part 1 and the superalloy.

Process Example:

The powder mixture 2 is ground for 10 minutes to obtain a homogeneous pack.

It is then advantageously vibrated to increase the bulk density of the powder mixture 2 and allow better contact between the powder and the part 1 to be coated.

The molybdenum or molybdenum-based alloy parts to be coated are polished to remove sharp edges and minimize roughness. The arithmetic mean roughness of the parts after polishing is advantageously less than 0.6 microns.

The parts are cleaned and degreased and then immersed in the powder, preferably totally immersed, and then the powder mixture 2 is advantageously re-vibrated.

The chamber 3 is steamed to remove moisture from the powder and parts at 100° C. for 12 hours. The chamber 3 is then sealed under inert atmosphere by means of ceramic adhesive.

The heat treatment is then applied in inert atmosphere with a first temperature step between 100 and 350° C. to allow firing of the ceramic adhesive and sealing of the crucible, followed by a second temperature step between 1000 and 1100° C. for a period of 10 to 30 hours to achieve the deposit.

Structure of the Coating:

The process is configured to produce a coating 4 on the surface of the part 1, comprising a plurality of superimposed layers.

The coating 4 may comprise, directly in contact with the substrate 5, a first layer 6.

The first layer 6 may comprise a solid solution of aluminum and silicon in molybdenum denoted Mo (Si,Al).

The aluminum molar fraction in the first layer 6 can be comprised between 0% and 50%, preferably between 0% and 35%. The silicon molar fraction in the first layer 6 can be comprised between 0% and 40%, preferably between 0% and 25%.

The thickness of the first layer 6 can be comprised between 0.1 μm and 30 μm and preferably between 0.1 μm and 10 μm.

A second layer 7, covering the first layer 6 in contact therewith, comprises an aluminum-molybdenum alloy. The second layer 7 may comprise a mass proportion greater than 75% of aluminum-molybdenum alloy. The aluminum-molybdenum alloy comprises for example $Al_8Mo_3$.

The second layer 7 may further comprise a secondary phase having molybdenum-aluminum-silicon alloy inclusions. The second layer 7 advantageously comprises a mass proportion of less than 25% molybdenum-aluminum-silicon alloy inclusions. The composition of these inclusions can be a solid solution of aluminum and silicon in molybdenum denoted Mo(Si,Al) or $Mo_5(Si,Al)_3$ phase.

The thickness of the second layer 7 can be comprised between 1 and 50 μm.

The coating 4 also comprises a third layer 8 covering the second layer 7 in contact therewith.

The third layer 8 comprises a molybdenum-aluminum-silicon $Mo(Al,Si)_2$ alloy capable of forming a passivating oxide layer under oxidizing conditions. The combined molar fraction of silicon and aluminum in the layer 8 is comprised between 60% and 70%, preferably between 65% and 68%.

The third layer 8 can have a thickness comprised between 0.5 μm and 50 μm, preferably between 1 μm and 15 μm.

In this way, the first layer 6 provides cohesion between the coating 4 and the substrate 5. Its intermediate aluminum and silicon content in relation to the upper layers gives it an intermediate coefficient of thermal expansion between that of the substrate 5 and that of the second layer 7.

The coating 4 thus offers a better temperature resistance, in particular by virtue of the reduction of stresses due to differential expansion phenomena between the substrate 5 and the coating.

The second aluminum-rich layer 7 gives the coating 4 a high ductility and thus improves the mechanical strength of the entire coating 4. It limits the problems of crack propagation during thermal cycling, cracks which occur in the layer 8 following the formation of the passivating layer (Kirkendall effect described above).

The layer 8 plays the role of protection against oxidation under oxidizing conditions.

Examples of Embodiments:

Referring to FIG. 3*a* and FIG. 3*b*, the coating 4 consists of four layers such as:

- A first layer 6 of solid solution of aluminum and silicon in molybdenum, in contact with the substrate 5;
- A second layer 7 comprising an aluminum-molybdenum alloy $Al_8Mo_3$, the silicon molar fraction of the second layer being less than 2%, the second layer 7 covering the first layer 6 in contact therewith;
- A third layer 8 comprising a molybdenum-aluminum-silicon alloy $Mo(Al,Si)_2$ on the surface of the coating.

Such a coating 4 can be obtained by incorporating in the chamber 3 a powder mixture 2 comprising:

- a mass proportion comprised between 1 and 10% of a precursor of a first doping component, here a silicon powder, with a purity of at least 99%, and with a grain diameter of less than 44 μm;
- a mass proportion comprised between 1 and 10% of a precursor of a second doping component, here an aluminum powder with a purity of at least 99.5%, with a 50% grain diameter of less than 11 μm;
- a mass proportion comprised between 1 and 10% of an activator component, here ammonium chloride $NH_4Cl$ powder with a purity of at least 99.5%, with a grain diameter comprised between 1 and 3 mm;
- a mass proportion comprised between 70 and 95% of an inert component, here an alumina powder with a 50% grain diameter of less than 1 μm.

The composition of the powder mixture 2 optionally but advantageously comprises, to within 2% by mass fraction: 7% precursor of the first doping component, 3% precursor of the second doping component, 7% activator component and 83% inert component.

In an embodiment, the powder mixture 2 includes a mass proportion comprised between 6 and 8% of activator component and between 8 and 12% by mass of a mixture of aluminum and silicon powder, the remainder of inert diluent to reach 100%, selected from refractory mineral oxide powders, the mixture of aluminum and silicon powder having a silicon/aluminum mass ratio comprised between 2 and 5.

Such a mixture improves the creation of the protective layer.

Such a mixture makes it possible to manufacture a part 1 made of a refractory metal alloy comprising molybdenum at least partially covered by a coating 4 comprising a plurality of superimposed layers, of which at least:

- a first layer 6 comprising a solid solution of aluminum and silicon in molybdenum denoted Mo (Si,Al), has a thickness comprised between 0.1 μm and 1 μm, and has an aluminum molar fraction comprised between 0.1% and 35% and a silicon molar fraction comprised between 0.1% and 25%,
- a second layer 7 comprising a mass proportion of more than 75% of an aluminum molybdenum alloy $Al_8Mo_3$ and has a thickness comprised between 1 and 30 μm,
- a third layer 8 having a thickness comprised between 1 μm and 25 μm and comprises a aluminum silicon-molybdenum alloy $Mo(Si,Al)_2$, the third layer having a combined atomic fraction of silicon and aluminum comprised between 65% and 68% and configured to generate a passive oxide layer when exposed to oxidizing conditions.

Carburization can be carried out in a chamber 3 with a volume of 50 $cm^3$, wherein the powder mixture 2 incorporated contains 1.75 g of silicon powder, 0.75 g of aluminum powder, 1.75 g of ammonium chloride and 20.75 g of alumina powder.

Carburization can be carried out in a chamber 3 of different volume by proportionally adapting the mass amount of powder mixture 2 in the chamber 3 to the volume of the chamber 3.

The $AlCl_3$ vapor phase concentration obtained in the chamber 3 with such a composition of powder mixture 2 produces a higher aluminum content in the coating 4.

This leads in particular to the formation of an aluminum-molybdenum $Al_8Mo_3$ phase in the coating in addition to the molybdenum-silicon-aluminum $Mo(Si,Al)_2$ alloy phase.

The ductility of the aluminum-rich coating is superior to that of a coating comprising chiefly a molybdenum-silicon-aluminum $Mo(Si,Al)_2$ alloy.

The presence of the third layer 8, comprising the molybdenum-silicon-aluminum $Mo(Si,Al)_2$ alloy in the coating 4 guarantees the oxidation resistance by allowing the formation of a passivating alumina layer at temperature in an oxidizing atmosphere.

In the case where the part 1 coated with coating 4 is used as a refractory core in an investment casting process for the manufacture of a superalloy turbine blade, the passivating alumina layer on the coating 4 is formed during the steps of firing the ceramic core and firing the shell, which are carried out in the presence of oxygen (usually in air). The alumina layer prevents oxidation at the core of the part 1 during these firing steps. In addition, the low wettability of nickel-based superalloys with alumina makes this layer also protective of any chemical reactivity between the part 1 and the molten superalloy during casting.

In order to control the thickness of the oxide layer on the coating 4, it is possible to subject the part 1 coated with the coating 4 (in this case called the refractory core) to preliminary oxidation of the coating before the steps of firing the ceramic core and the shell. The refractory core coated with the coating 4 can thus be subjected for example to a heat pretreatment in air at a temperature comprised between 1000 and 1500° C.

The invention claimed is:

1. A process comprising:

coating a part by chemical vapor diffusion;

placing a powder mixture in a chamber, the powder mixture comprising at least one first component, at least one second component and an inert component;

the powder mixture including a mass proportion comprised between 6 and 8% of the first component and between 8 and 12% of the second component;

the first component comprising at least one halide species selected from NH4Cl, NH4F, AlCl3, CrCl2;

the second component comprising at least one species selected from silicon, aluminum, iron, copper, cobalt, nickel, lanthanum, germanium, zirconium, chromium, titanium, hafnium, rhenium and a mixture thereof;

immersing the part at least partially in the powder mixture, the part comprising a metal refractory alloy, the metal refractory alloy comprising molybdenum; and heat treating the part, the first component and the second component forming a gaseous compound during the heat treating step so as to allow deposition of the second component on the part;

the second component forming a solid diffusion alloy by solid diffusion with at least one metal species of the metal refractory alloy so as to generate a coating;

the solid diffusion alloy generating a passivating oxide layer when subjected to oxidizing conditions;

wherein the process produces a coating on the part, the coating comprising a plurality of superimposed layers;

the superimposed layers comprising:

a first layer having a thickness comprised between 0.1 μm and 30 μm, a molar fraction of the second component in the first layer being comprised between 0 and 50%, a second layer covering the first layer and having a thickness comprised between 1 μm and 50 μm, the second layer having a molar fraction of the second component less than 2%;

a third layer covering the second layer and having a thickness comprised between 0.5 μm and 50 μm, the third layer having a molar fraction of the second component comprised between 60 and 70%.

2. The process as claimed in claim 1, wherein the powder mixture includes a mass proportion comprised between 1 and 20% of the second component and a mass proportion comprised between 1 and 10% of the first component based on the total mass of the powder mixture.

3. The process as claimed in claim 1, wherein:

the second component is a mixture of a silicon powder and an aluminum powder, and the first component is ammonium chloride.

4. The process as claimed in claim 1, wherein the powder mixture further includes a mass proportion comprised between 80 and 86% of an inert component.

5. The process as claimed in claim 4, wherein the powder mixture comprises between 82 and 84% by mass of inert component.

6. The process as claimed in claim 4 wherein the inert component is an alumina powder.

7. The process as claimed in claim 1, wherein the powder mixture comprises:

a mass proportion comprised between 6 and 8% of the first component, a mass proportion comprised between 8 and 12% of the second component, the second component being a mixture of aluminum and silicon powder, and a mass proportion of inert component comprised between 80% and 86%, the inert component comprising one refractory mineral oxide powder or a combination of refractory mineral oxide powders.

* * * * *